US008522439B1

(12) United States Patent
Neuman

(10) Patent No.: US 8,522,439 B1
(45) Date of Patent: Sep. 3, 2013

(54) SYSTEM AND METHOD FOR STRINGING DECORATIVE JEWELRY ELEMENTS

(76) Inventor: Christopher G. Neuman, Perkasie, PA (US)

( * ) Notice: Subject to any disclaimer, the term of this patent is extended or adjusted under 35 U.S.C. 154(b) by 224 days.

(21) Appl. No.: 13/149,862

(22) Filed: May 31, 2011

(51) Int. Cl.
*A44C 27/00* (2006.01)

(52) U.S. Cl.
USPC ..... 29/896.4; 29/10; 29/241; 29/433; 29/896.411; 29/896.43; 63/3; 63/3.1; 223/48

(58) Field of Classification Search
USPC ..... 29/10, 241, 433, 896.4, 896.41, 896.411, 29/896.43; 43/42.53, 44.9; 63/3, 3.1; 139/29, 139/33, 34; 223/48; 269/47; 289/17
See application file for complete search history.

(56) References Cited

U.S. PATENT DOCUMENTS 244,452 A * 7/1881 Halstenbach ..... 223/48
1,336,777 A * 4/1920 Elliott ..... 227/33
2,529,059 A * 11/1950 Tell ..... 223/48
3,545,069 A * 12/1970 Krieger ..... 29/433
5,395,245 A * 3/1995 Heinz ..... 434/204
5,664,707 A * 9/1997 Spector ..... 223/48
8,132,596 B2 * 3/2012 Weidler et al. ..... 139/29
2010/0212770 A1 8/2010 Weidler et al.

* cited by examiner

*Primary Examiner* — Alexander P Taousakis
(74) *Attorney, Agent, or Firm* — LaMorte & Associates PC

(57) ABSTRACT

A system and method for stringing decorative elements onto a stringing element to make jewelry, such as a necklace or bracelet. A jig is provided that has holds a first tube. The first tube has a first end, a second end, an inside diameter and an outside diameter. The outside diameter is smaller than the inside diameter of the stringing holes in the decorative elements. The first tube is set as a cantilever. At least some of the decorative elements are set onto the first tube over its first end. The first tube extends through the stringing hole in each of the decorative elements. A stringing element is advanced through the first tube. The first tube is then removed. This leaves at least some of the stringing element strung through the stringing hole of each of the decorative elements.

13 Claims, 3 Drawing Sheets

SYSTEM AND METHOD FOR STRINGING DECORATIVE JEWELRY ELEMENTS

BACKGROUND OF THE INVENTION

1. Field of the Invention

In general, the present invention relates to jewelry jigs and like devices that are used by jewelry manufacturers when making strung jewelry. More particularly, the present invention relates to devices and methods that assist a person in passing a stringing element through a decorative piece of jewelry.

2. Description of the Prior Art

People have created threaded jewelry in the form of necklaces and bracelets since before the start of recorded history. In this vast span of time, the techniques used to create threaded jewelry have changed very little. Decorative elements, such as beads, stones, shells, pearls or the like are provided, wherein a small hole is formed through the decorative element. A thread, string, wire or thin chain is then strung through the holes in the decorative elements to create the jewelry.

When threaded jewelry is being made, the jewelry maker typically tries to obtain symmetry in the threaded jewelry. That is, one side of the threaded jewelry has essentially the same size and number of decorative elements as does the other side of the threaded jewelry. To achieve this symmetry, a jewelry maker will typically lay out the decorative elements in a model layout prior to threading those decorative elements together. In this manner, a jewelry maker can mix and match various decorative elements in order to achieve symmetry and/or a desired artistic design. In many craft shops and bead shops, bead holding jigs are provided that are designed to hold model layouts of beads or similar decorative elements. Such prior art jigs are exemplified by U.S. Patent No. 2010/0212770 to Weidler, entitled Beadin' Butler System. Although such jigs help a jewelry designer lay out decorative elements, the jewelry designer must still string a connective thread, wire, or chain though the various decorative elements that have been selected. This is typically done by hand. Consequently, depending upon the number of decorative elements selected and the size of those decorative elements, a significant amount of time and labor is required to create the jewelry.

For expensive jewelry, the cost of time and labor is small as compared to the value of the decorative elements being used in the jewelry and the sales price of the jewelry. However, for inexpensive jewelry, craft jewelry and costume jewelry, the cost of time and labor needed to manufacture the jewelry can easily surpass the cost of the decorative elements being used in the jewelry. Accordingly, in order to be sold profitably, the cost of the jewelry must be significantly higher than the value of the decorative elements within the jewelry. This overprice of the jewelry can make the jewelry more difficult to sell or it results in smaller profit margins in sales that are made.

It will therefore be understood that a need exists for a system and method that can greatly reduce the time and labor needed to create a model layout of decorative elements for jewelry and reduce both the time and the labor needed to string those decorative elements together. This need is met by the present invention as described and claimed below.

SUMMARY OF THE INVENTION

The present invention is a system and method for stringing decorative elements onto a stringing element to make jewelry, such as a necklace or bracelet. A plurality of decorative elements are selected by a jewelry maker. Each of the decorative elements has a stringing hole of a predetermined diameter formed through its center. A pendant or other specialized ornaments may also be selected.

A jig is provided that has holds a first tube. The first tube has a first end, a second end, an inside diameter and an outside diameter. The outside diameter of the first tube is smaller than the inside diameter of each of the stringing holes in the decorative elements. The first tube is set as a cantilever. As such, the first end of the first tube is freely suspended. At least some of the decorative elements are set onto the first tube over its first end. The first tube extends through the stringing hole in each of the decorative elements.

A stringing element is provided. The stringing element is sized to fit inside the first tube. The stringing element is advanced through the first tube. The first tube is then removed. This leaves at least some of the stringing element strung through the stringing hole of each of the decorative elements previously advanced onto the first tube.

An optional second tube can be provided and used to string a second set of decorative elements. A pendant can be set between the two tubes.

The result is a jig that enables decorative elements to be strung together in a highly labor and time efficient manner.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
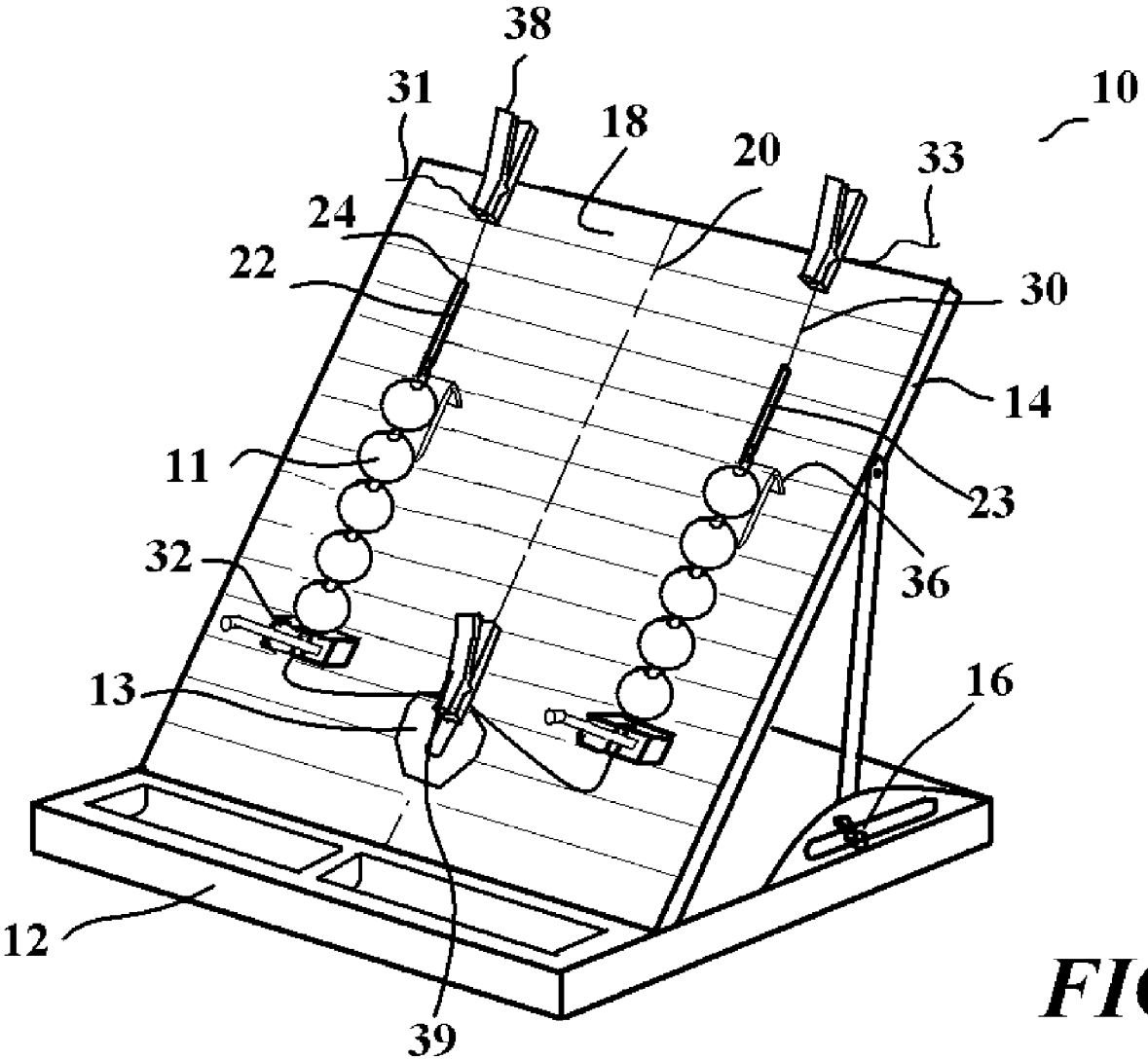
FIG. 1 is a perspective view of an exemplary embodiment of a jewelry jig assembly shown in conjunction with decorative elements and a stringing element.
Figure 2:
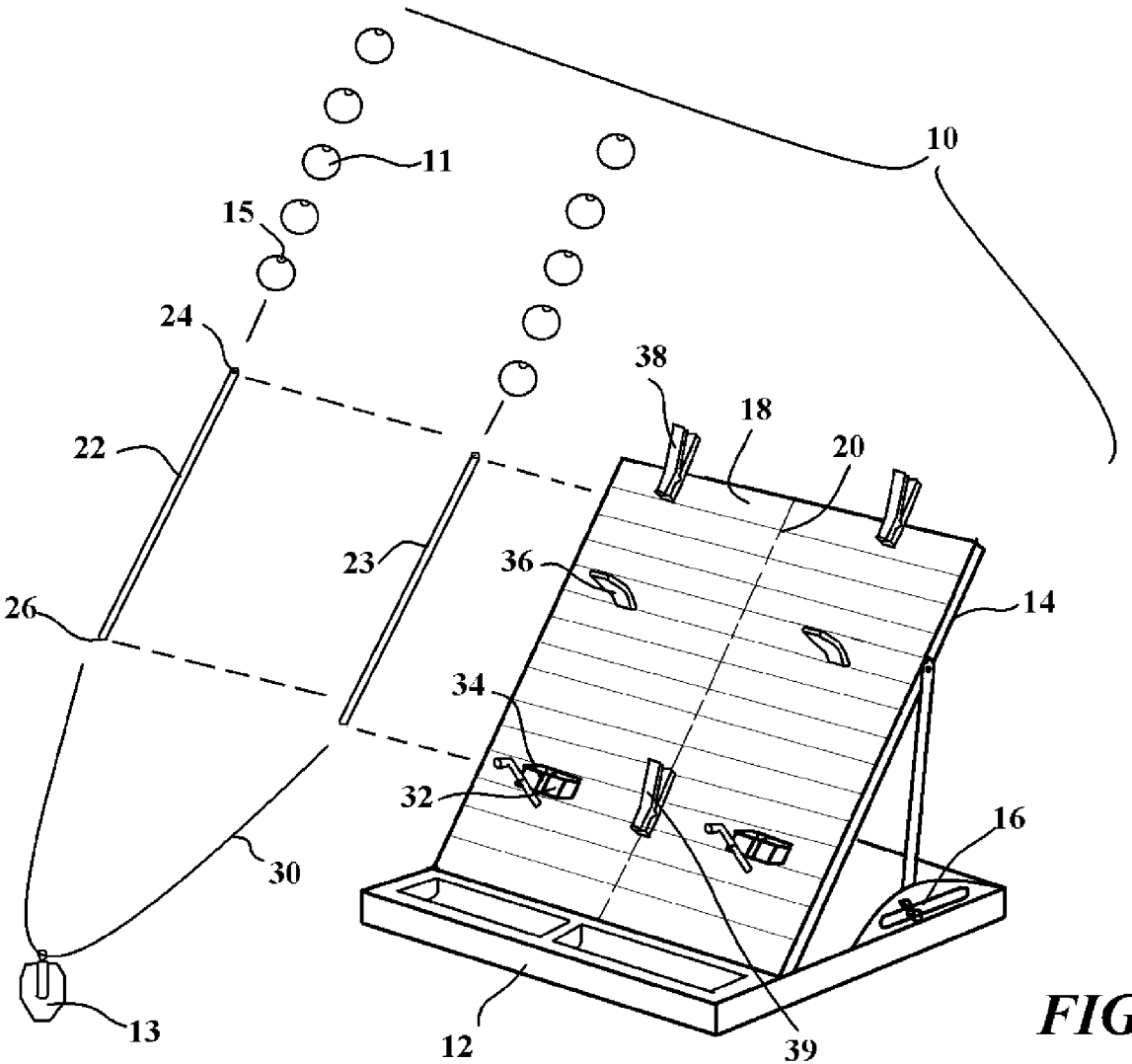
FIG. 2 is an exploded view of the embodiment shown in FIG. 1.

Referring to FIG. 1 in conjunction with FIG. 2, a jewelry jig assembly 10 is shown. The purpose of the jig assembly 10 is to help a user string together a plurality of decorative elements 11 to create a piece of jewelry such as a necklace or bracelet. The decorative elements 11 each have a string hole 15 no smaller than some predetermined minimum diameter. The decorative elements 11 may, or may not, include a central pendent 13.

The jewelry jig assembly 10 has a base 12 and an inclined surface 14 that stands upon the base 12. The inclined surface 14 can be angled between thirty degrees and seventy degrees with respect to the horizontal base 12. The inclined surface 14 and the base 12 can be statically interconnected. However, in the exemplary embodiment being illustrated, an adjustment mechanism 16 is provided. The adjustment mechanism 16 enables the angle of the inclined surface 14 to be selectively adjusted throughout the aforementioned range. In this manner, the inclined surface 14 may be made adjustable so that it can be selectively adjusted to the ergonomic needs of a particular user.

The inclined surface 14 has a face 18 that faces the user. A reference grid 20 is printed or applied to the face 18 of the inclined surface 14. The reference grid 20 has various horizontal and vertical guidelines that enable a user to better judge the size and symmetry of the decorative elements 11, as will later be explained.

Two string tubes 22, 23 are provided. The string tubes 22, 23 can be extruded solid-wall tubes. However, the string tubes 22, 23 can also be tightly wound coil springs. Each of the string tubes 22, 23 has a top end 24, a bottom end 26, an outside diameter and an inside diameter. The length of each string tube 22, 23 can be between three inches and twelve inches, with a preferred length of between four inches and eight inches for use in making necklace jewelry. The outside diameter of each string tube 22, 23 is smaller than the smallest string hole 15 in the decorative elements 11 being strung. Accordingly, if decorative elements 11 have a minimum string hole diameter of 1.5 millimeters, a string tube 22, 23 having an outside diameter of 1.4 millimeters or less would be appropriate.

The inside diameter of each spring tube 22, 23 is larger than the outside diameter of a stringing element 30 being used to string the decorative elements 11 together. For example, if a one millimeter stringing element 30 is being used, a string tube 22, 23 having an inside diameter of 1.1 millimeters or larger would be appropriate. It will be understood that the stringing element 30 can be thread, wire, chain or any other stringing element used in the production of jewelry. The stringing element 30 is provided as a cut length. Accordingly, the stringing element 30 has a first end 31 and an opposite second end 33 before the jewelry is made.

Ledges 32 extend outwardly from the face 18 of the inclined surface 14. The ledges 32 contain receptacles 34 for selectively receiving and engaging the bottom ends 26 of the string tubes 22, 23. The receptacles 34 are slotted so that the stringing element 30 can pass through the ledges 32 even while the string tubes 22, 23 are retained in the receptacles 34. The receptacles 34 may have latches 36 that lock the bottom ends 26 of the string tubes 22, 23 in the receptacles 34, once the string tubes 22, 23 are properly seated. The receptacles 34 retain the bottom ends 26 of the string tubes 22, 23 and hold the string tubes 22, 23 as cantilevers in a plane parallel to the face 18 of the inclined surface 14. It will therefore be understood that when the string tubes 22, 23 are engaged within the receptacles 34, the string tubes 22, 23 extending above the ledges 32 are unsupported and extend freely toward their top ends 24 as a cantilever. However, the string tubes 22, 23 can be selectively removed from the receptacles 34 on the ledges 32 by a user. Accordingly, it will be understood that the string tubes 22, 23 can be replaced to meet the needs of a user and the decorative elements 11 being strung.

Flexible supports 36 extend outwardly from the face 18 of the inclined surface 14. The flexible supports 36 are positioned under the string tubes 22, 23. However, the flexible supports 36 are not attached to the string tubes 22, 23 and normally do not even touch the string tubes 22, 23.

Two end clips 38 are provided on the top edge of the inclined surface 14. Likewise, at least one pendent clip 39 is provided on the inclined surface 14 below the ledges 32.

To use the jewelry jig assembly 10, the jewelry jig assembly 10 is placed on a flat surface in front of a user. The user selects the various decorative elements 11 that the user intends to string together. The user may also include a central pendent 13 if a necklace is being made. Furthermore, the user selects an appropriate length of the stringing element 30 that will be used to string the decorative elements 11 together. Once the stringing element 11 is selected and the length of the strung jewelry is decided, the user selects the appropriate string tubes 22, 23 for the application. The length of the selected string tubes 22, 23 is determined by the length of the strung jewelry being created. Likewise, the diameter of the string tubes 22, 23 is selected for the string holes 15 in the decorative elements 11 and the diameter of the stringing element 30 being used. It will therefore be understood that a jewelry design may collect many different string tubes of different lengths, different inside diameters and different outside diameters to create jewelry using different decorative elements and different stringing elements.

To create a piece of strung jewelry, a user selects the decorative elements 11 and perhaps a pendant 13. The pendant 13 can be set onto the face 18 of the inclined surface 14 using the pendent clips 39. The selected string tubes 22, 23 are set into receptacles 34 on the ledges 32 so that they extend upwardly as cantilevers. The user then advances the various decorative elements 11 over the string tubes 22, 23 by passing the string tubes 22, 23 through the string holes 15 of the decorative elements 11. The decorative elements 11 stack atop one another along the length of the string tubes 22, 23. This can be done very rapidly. Furthermore, by stacking the decorative elements 11 along the two string tubes 22, 23, a user can visualize the completed necklace and check for both aesthetics and symmetry. This design assessment is helped by the fact that the stacks of decorative elements 11 stand in front of the reference grid 20 on the inclined surface 14.

Depending upon the type of decorative elements 11 being used, the weight of the decorative elements 11 on each of the string tubes 22, 23 can be significant. To prevent the string tubes 22, 23 from bending, the flexible supports 36 under the string tubes 22, 23 contact the decorate elements 11 and prevent the spring tubes 22, 23 from bending under the applied weight. The flexible supports 36 also enable the decorative elements 11 to be advanced along the string tubes 22, 23 unabated. The flexibly of the flexible supports 36 enable a decorative element 11 to slide past the flexible support 36 with little resistance.

Once the string tubes 22, 23 are covered with the desired sequence of decorative elements 11, an appropriate length of stringing element 30 is cut. If a pendant is being used, the stringing element 30 is strung through the pendant 13 so that the pendant 13 is near the center of the stringing element 30. Once the string tubes 22, 23 are selected, the free ends 31, 33 of the stringing element 30 are advanced through the selected string tubes 22, 23. Accordingly, the pendant 13 is suspended on the stringing element 30 between the two string tubes 22, 23. The free ends 31, 33 of the stringing element 30 are temporarily held by the end clips 38 to help prevent the string tubes 22, 23 from bending under the weight of the decorative elements.

Once the desired sequence of decorative elements 11 is placed onto the string tubes 22, 23 and the stringing element 30 is strung through the tubes 22, 23, the string tubes 22, 23 are disengaged from the receptacles. The string tubes 22, 23 are then pulled out of the decorative elements 11 and off of the stringing element 30 by pulling the string tubes 22, 23 past the free ends 31, 33 of the stringing element 30.

What remains are the decorative elements 11 and pendant 13 strung on the stringing element 30. The free ends 31, 33 of the stringing element 30 are terminated with a clasp or knot and the jewelry is complete.

Figure 3:
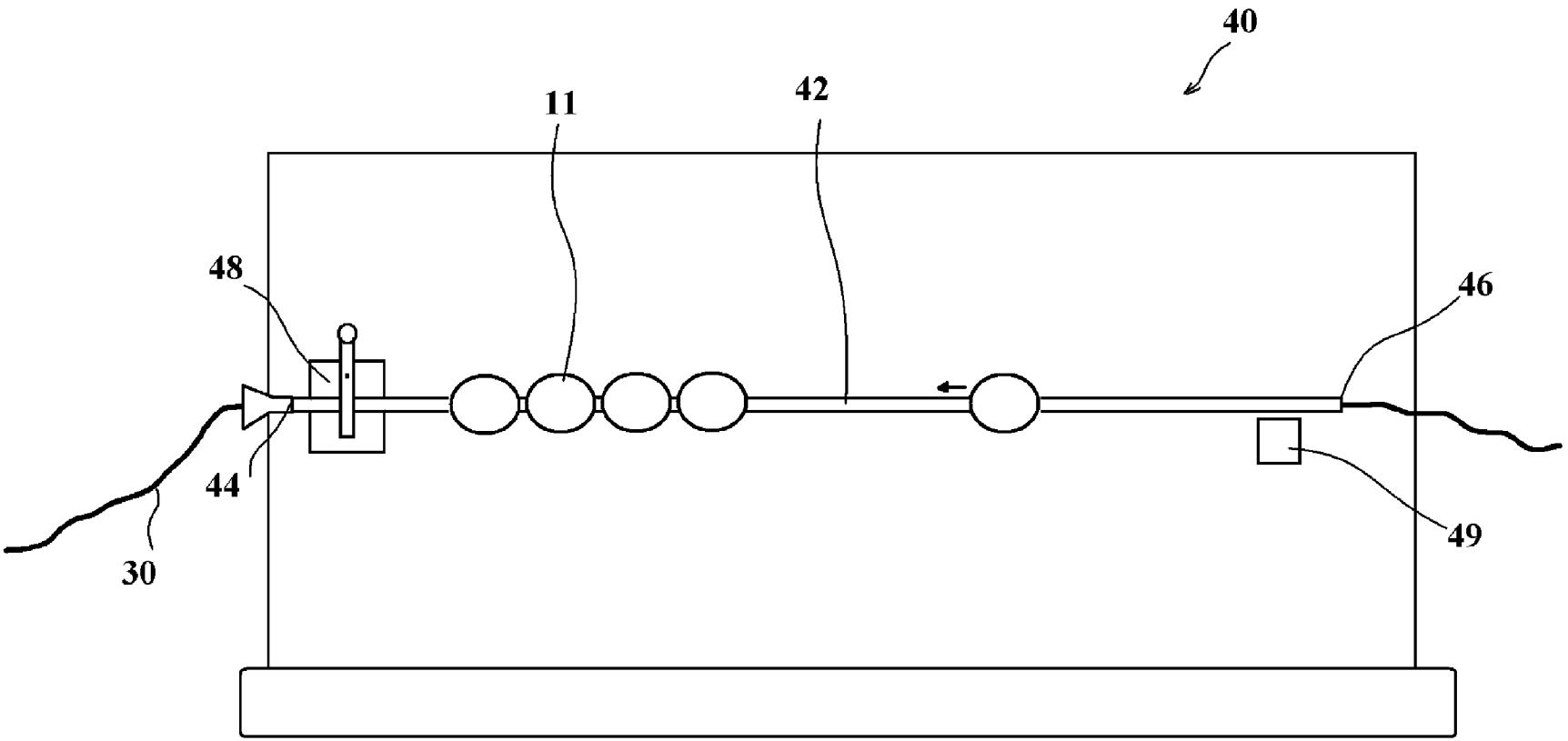
FIG. 3 is a front view of an alternate embodiment of the present invention.

Referring to FIG. 3, an alternate embodiment of a jewelry jig assembly 40 is shown. In this embodiment, a single string tube 42 is used. The string tube 42 has two ends 44, 46. The first end 44 of the string tube 42 is set into a receptacle 48. The first end 44 of the string tube 42 may also be flared so that a stringing element 30 can be easily advanced into the string tube 42. The second end 46 of the string tube 42 rests just above a support ledge 49.

To create a piece of jewelry, a user advances decorative elements 11 onto the string tube 42. The decorative elements 11 are advanced over the second end 46 of the string tube 42.

Once the decorative elements 11 are set onto the string tube 42, the second end 46 of the string tube 42 rests upon the support ledge 49 and is prevented from bending.

A length of a stringing element 30 is advanced through the string tube 42. Once through the string tube 42, the string tube 42 is disengaged from the receptacle 48 and is pulled away. As the string tube 42 is pulled away, the stringing element 30 remains inside the decorative elements 11. The ends of the stringing element 30 are terminated and the jewelry is complete.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A method of stringing decorative elements, comprising the steps of:

providing decorative elements, wherein each of said decorative elements has a stringing hole of a predetermined diameter;

providing a first tube having a first end, a second end, an inside diameter and an outside diameter, wherein said outside diameter is smaller than said predetermined diameter of each said stringing hole;

setting said first tube as a cantilever, wherein said first end of said first tube is freely suspended;

advancing at least some of said decorative elements onto said first tube over said first end, wherein said first tube extends through said stringing hole in each of said decorative elements;

providing a stringing element;

advancing a stringing element through said first tube;

removing said first tube, therein leaving at least some of said stringing element strung through said stringing hole of each of said decorative elements previously advanced onto said first tube.

2. The method according to claim 1, wherein said step of setting said first tube as a cantilever includes orienting said first end of said first tube higher than said second end so that gravity assists said decorative elements to move toward said second end of said first tube.

3. The method according to claim 1, further including the step of providing a reference grid and positioning said reference grid proximate said first tube so that said decorative elements set onto said first tube can be viewed with said reference grid as a backdrop.

4. The method according to claim 1, further including providing a second tube.

5. The method according to claim 4, further including the step of setting said second tube as a cantilever parallel to said first tube.

6. The method according to claim 5, further including the step of advancing some of said decorative elements over said second tube.

7. The method according to claim 6, wherein said step of providing a stringing element includes providing a stringing element having a first end, a second end, and a diameter smaller than said inside diameter of said first tube.

8. The method according to claim 7, further including the step of advancing said first end of said stringing element through said first tube and advancing said second end of said stringing element through said second tube.

9. The method according to claim 8, further including the step of removing said second tube, therein leaving at least some of said decorative elements strung through said stringing.

10. The method according to claim 8, wherein said step of providing decorative elements includes providing a central pendant, wherein said method further includes the step of stringing said central pendant onto said stringing element before said stringing element is advanced into said first tube and said second tube.

11. A method of stringing decorative elements and a pendent onto a necklace, said method comprising the steps of:

providing decorative elements, wherein each of said decorative elements has a stringing hole;

providing a pendant;

providing a first tube and a second tube;

advancing at least some of said decorative elements over both said first tube and said second tube;

providing a stringing element having a first end and a second end;

stringing said stringing element through said pendant, wherein said pendent is positioned between said first end and said second end of said stringing element;

advancing said first end of said stringing element through said first tube;

advancing said second end of said stringing element through said second tube;

removing both said first tube and said second tube, therein leaving at least some of said stringing element strung through each of said decorative elements previously advanced over said first tube and said second tube.

12. The method according to claim 11, further including the step of providing a reference grid and positioning said reference grid proximate both said first tube and said second tube so that said decorative elements set onto said first tube and said second tube can be viewed with said reference grid as a backdrop.

13. The method according to claim 11, further including the step of setting both said first tube and said second tube in parallel orientations.

* * * * *